United States Patent [19]

Rainer et al.

[11] 4,388,933

[45] Jun. 21, 1983

[54] TOBACCO STEM TREATMENT AND EXPANDED TOBACCO PRODUCT

[75] Inventors: Norman B. Rainer; Dean M. Siwiec, both of Richmond, Va.

[73] Assignee: Philip Morris, Inc., New York, N.Y.

[21] Appl. No.: 277,571

[22] Filed: Jun. 25, 1981

[51] Int. Cl.[3] ..... A24B 3/18

[52] U.S. Cl. ..... 131/293; 131/903; 131/352

[58] Field of Search ..... 131/291–296, 131/903, 309, 310, 352

*Primary Examiner*—V. Millin

*Attorney, Agent, or Firm*—Arthur I. Palmer, Jr.; George E. Inskeep

[57] ABSTRACT

An improved process for expanding tobacco is disclosed wherein tobacco components such as stems, midribs and veins are contacted with an alkaline-hydrogen peroxide solution and thereafter dried and roasted to produce an expanded tobacco material highly suitable for use in smoking products. In a preferred approach, tobacco is treated with a hydroxide or oxide of a multivalent metal and then contacted with a solution of hydrogen peroxide; thereafter the tobacco is dried and roasted to produce an expanded tobacco product.

17 Claims, No Drawings

TOBACCO STEM TREATMENT AND EXPANDED TOBACCO PRODUCT

FIELD OF THE INVENTION

The present invention relates to an improved process for expanding tobacco and to the improved product thereby produced. More particularly the invention provides a process wherein tobacco components such as stems, midribs and veins are contacted with hydrogen peroxide solution under alkaline conditions in the presence of multivalent metal cations to effect expansion, and then dried and roasted to produce an expanded tobacco material highly suitable for use in smoking products. In an alternate approach, the tobacco may be pretreated with a hydroxide or oxide of a multivalent metal selected from calcium, magnesium or aluminum. The multivalent cation may also be incorporated directly into the hydrogen peroxide solution.

DESCRIPTION OF THE PRIOR ART

The use of hydrogen peroxide in tobacco processing has been suggested for various purposes. For example, it has been employed to bleach dark fermented tobacco leaf to obtain a more desirable golden color. In U.S. Pat. No. 2,341,535, tobacco leaf is treated with an ammoniacal solution of hydrogen peroxide to improve color and taste. The treatment involves the application of hydrogen peroxide solutions of at least 11 percent concentration in amounts such that the total water content is between 21 and 35 pounds per 100 pounds of tobacco. The treated tobacco leaf is then stored in a loose pile for 16 to 24 hours at temperatures ranging as high as 120° F. Subsequently the tobacco is heated to remove excess hydrogen peroxide. There is no mention of increased filling power.

In some instances, oxidizing agents such as hydrogen peroxide or ozone have been suggested for use in reducing certain constituents in tobacco. In Chemical Abstracts (hereinafter CA) 85:75205, plants such as tobacco are treated with an oxidizing agent followed by treatment with ammonia or other alkaline materials. Steam distillation subsequently serves to remove alkaloids such as nicotine. In CA 80:45796g, fermented tobacco is improved by treatment with hydrogen peroxide and heat. Such treatment apparently results in partial oxidation of the cellulose and nicotine present.

In CA 72:51949k, there is described the treatment of tobacco leaf with hydrogen peroxide at a concentration of 7% for 25 hours at 40°, which treatment is said to increase the sugar/nicotine ratio, filling power and total volatile acids and decrease the total carbonyl content. CA 80:130648c describes a similar type treatment of tobacco leaf with 32% hydrogen peroxide at 45°, which treatment apparently resulted in increased filling power of the leaf by 15 to 20% and lowered nicotine content by 32.2% when compared with untreated leaf. In each instance the processes appear to be limited to the treatment or modification of tobacco leaf.

U.S. Pat. Nos. 3,612,065; 3,889,689; 3,943,945 and 4,013,082 to Rosen describe methods for expanding tobacco wherein the tobacco is treated with an enzyme solution of catalase followed by the addition of a solution of hydrogen peroxide solution. According to the inventor, excessive amounts of hydrogen peroxide are to be avoided, otherwise undesirable oxidation of the tobacco occurs. Generally, the concentration of hydrogen peroxide employed should be in the range of 10 to 50 volumes, and preferably 20 to 40 volumes, according to the inventor. The enzyme catalase catalyzes the decomposition of hydrogen peroxide to yield water and oxygen gas. The oxygen gas serves to expand the tobacco.

The '689 patent relates to the use of physical force, such as rollers and the like, to effect better impregnation of the catalase and hydrogen peroxide solutions into the tobacco. The '945 patent describes methods for expanding reconstituted tobacco using hydrogen peroxide and catalase while the '082 patent describes the use of negative pressure to cause oxygen gas resulting from the reaction of catalase and hydrogen peroxide to form large bubbles in the tobacco cell interstices thereby effecting greater expansion of the tobacco.

An additional patent to Rosen, U.S. Pat. No. 3,851,653, describes a process wherein tobacco lamina is first treated with sufficient hydrogen peroxide at 70° to 140° F. to oxidize the nicotine and tars contained therein followed by sufficient catalase to decompose the hydrogen peroxide remaining in the tobacco. Puffing occurs prior to drying. After conventional drying, the filling capacity is said to have increased by 40.4%.

Techniques proposed especially for the expansion of tobacco stems include U.S. Pat. No. 3,409,022 wherein tobacco stems having a moisture content in the range of 4 to 23% by weight are exposed to a source of radiant energy at sub-atmospheric pressure to effect expansion thereof.

Other patents related to expansion of tobacco stems wherein heat treatment or microwave energy are employed include U.S. Pat. Nos. 3,409,023; 3,409,027 and 3,409,028. U.S. Pat. No. 3,734,104 also relates to a process for the expansion of tobacco stems.

U.S. Pat. No. 3,425,425 describes the treatment of tobacco stems with an aqueous carbohydrate solution comprising in addition from 0 to 200 parts by weight of a compound selected from citric acid, malic acid, phosphoric acid, monobasic potassium phosphate, ammonium hydroxide, calcium chloride, potassium hydroxide, potassium nitrate, potassium acid phosphate, sodium chloride and mixtures thereof. Following a suitable impregnation period, the stems are exposed to a source of heat to effect expansion. In some instances, the stems may be water extracted prior to treatment with the carbohydrate solution.

Various divalent salts have been proposed as additives for tobacco products. For example, CA 65:5891a (Netherlands Application 6,511,755 published March 15, 1966) discloses the addition of alkali metal and/or alkaline earth metal salts to tobacco or filters to improve smoking characteristics. Particularly preferred are the salts of weak acids such as, for example, the alkali metal carbonates, bicarbonates and bisulfites. Sodium, potassium, lithium, barium and calcium salts are specified by the inventor. Generally the final product should contain between 0.1 and 0.5% of the salt by weight of the tobacco.

Multivalent salts in minute quantities have been suggested for incorporation in reconstituted tobacco. See, for example, U.S. Pat. No. 2,598,608.

U.S. Pat. No. 2,914,072 describes the use of metallic and organic salts is combination, as catalysts, to promote greater combustion and thermal destruction of the undesirable alkaline, especially nicotine-base alkaline, by-products found in the smoke. U.S. Pat. No. 2,429,567 describes a method of reducing the nicotine content of tobacco by means of salt additives, especially chloride salts, which bind with the nicotine released upon burning.

Other workers have proposed the use of multivalant metals or acids by one means or another to improve the flavor of the tobacco by binding acids and/or bases of the smoke of combustion. See, for example, U.S. Pat. Nos. 757,514 and 2,029,494.

In co-pending, commonly assigned application Serial No. 938,118 filed Aug. 30, 1978, there is described a method for increasing the filling power of a blended tobacco filler material by applying to the tobacco a solution of a multivalent salt to a level of about 0.2 to 7.5% by dry weight of the tobacco. The salts of the multivalent metals found to be effective in cross-linking pectinaceous materials include the salts of the alkaline earth metals, metals of the periodic table transition series and combinations of these with the alkali metals including, for example, aluminum, calcium, magnesium, titanium, zinc, chromium, manganese, molybdenum, nickel, tin and iron.

The acids of said salts which have been found to be effective include malonic, malic, tartaric, adipic, lactic, glycolic, fumaric, ascorbic, aspartic, glutamic, sulfamic, formic, gallic, phosphoric, citric, oxalic, succinic and tannic. Through interaction with the pectinaceous materials of the tobacco filler, the aforesaid additive salt solutions cause, upon drying, the retention of the expanded form of the tobacco by stiffening and firmly binding the expanded pectinaceous fibers of the tobacco. Although expansion in the range of 5 to 25% is observed in said co-pending application, the process of the present invention results in substantially greater expansion thereby resulting in a more economical product for use in smoking articles.

In commonly assigned copending applications U.S. Ser. Nos. 277,315 and 277,570 both filed concurrently with the instant application, there is described tobacco expansion processes wherein cut and rolled tobacco stems are subjected to pretreatment with gaseous ozone or the salt of a multivalent metal to prevent clumping and interadherence of tobacco shreds during subsequent contact with an alkaline-hydrogen peroxide solution for the purpose of expanding the tobacco. Following contact with the alkaline-hydrogen peroxide solution, the tobacco stems are washed extractively, dried and optionally roasted to produce a highly expanded tobacco product.

While all of the above discussed expansion processes result in an increase in filling capacity of tobacco and, in some instances, tobacco stems, none have been found entirely suitable for various reasons.

Although highly expanded tobacco products are obtained, the pretreatment steps of tobacco stems described hereinabove, may, in some instances, require costly reagents, and generally processes which require washing or extraction and subsequent drying of the tobacco materials are considered energy intensive. It was desirable, therefore, to develop an expansion process for tobacco stems wherein pretreatment and extraction of the tobacco could be avoided if possible, while at the same time preventing clumping on exposure to hydrogen peroxide. We have now discovered, quite unexpectedly, that by carefully controlling the conditions during treatment, tobacco stems may be expanded with alkaline hydrogen peroxide without pretreatment and the washing or extraction step may be omitted, thereby offering a more economical approach for tobacco stem expansion.

Details of the invention will be described more fully hereinbelow.

SUMMARY OF THE INVENTION

The present invention relates to an improved process for the treatment of tobacco stems whereby the filling capacity of the stems is substantially increased and the density reduced as compared to ordinary cut tobacco stems normally used in filler.

The initial step of the process involves contacting whole or rolled and cut tobacco stem material with a critical amount of an aqueous solution of hydrogen peroxide under conditions such that the hydrogen peroxide in contact with the stem material is alkaline and is associated with a source of multivalent ions selected from the group consisting of calcium, magnesium and aluminum. In one embodiment of the invention, the solution of hydrogen peroxide may be made to contain dissolved or dispersed therein an alkaline compound and a compound comprised of the aforesaid multivalent ions. In a alternate embodiment, an alkaline compound and a compound comprised of multivalent ions may be applied to the tobacco stem material in a manner such that, when the stem material is subsequently contacted with an aqueous solution of hydrogen peroxide, the alkaline and multivalent ion compounds become effectively associated with the hydrogen peroxide solution. In certain instances, a single compound may function as both the alkaline compound and source of multivalent ions, exemplary specific compounds being $Ca(OH)_2$ and CaO.

Following contact with the hydrogen peroxide solution, the stem material is dried and roasted.

Tobacco stem material treated in accordance with the present invention has improved filling capacity in comparison with the precursor untreated stem material. By virtue of said increased filling capacity, the treated stem material, when incorporated into a cigarette, produces a firm cigarette having reduced weight of smokable material. Such cigarettes deliver reduced amounts of smoke. The treatment process also imparts improved subjectively perceivable smoking quality to the stem material.

DESCRIPTION OF THE PREFERRED EMBODIMENT

In accordance with the present invention, tobacco stem material, and particularly bright or burley tobacco stems, are contacted with an aqueous solution of hydrogen peroxide under alkaline conditions and in the presence of multivalent ions, preferably calcium, added to either the tobacco or aqueous solution. The stem material utilized will generally have a calcium content of natural origin in the range of about 1 to 2.5%, depending upon the agricultural factors affecting the tobacco plant's growth.

Prior to their treatment, the tobacco stems will generally be rolled or crushed in moist form according to known methods. It may be preferable to also cut the stems to filler size by conventional methods, namely 75 to 200 cuts per inch or smaller. In some instances it may be desirable to remove from the stems nitrate salts or other components by known extraction techniques. Ingredients may also be added to the stems prior to their contact with the peroxide solution. Such ingredients include alkaline materials and calcium compounds within the purview of the process of this invention and other ingredients which may enhance the results of the process of this invention, said other ingredients including: catalysts for the pyrolytic degradation of carbohydrates, exemplary of which is diammonium phosphate, compounds which control the rate of reaction of hydrogen peroxide, additives which generate gases, organic compounds oxidizable to carboxylic groups by hydrogen peroxide, substances having a plasticizing effect on the stems, and other ingredients commonly utilized for improving the smoking qualities of tobacco stem materials.

In accordance with the preferred embodiment of the invention, rolled and cut tobacco stems having a moisture content in the range of 2 to 40% moisture, and preferably 4 to 12% moisture, are spray treated with an aqueous hydrogen peroxide mixture containing dispersed therein at least one calcium compound selected from the group consisting of calcium oxide, calcium hydroxide and calcium peroxide, said calcium compound being present at a weight percent of 0.5 to 3.0% by weight of the peroxide mixture. The mixture, which may also contain ammonium hydroxide, will generally have a pH in the range of 8 to 12.

The amount of the aqueous hydrogen peroxide mixture applied to the tobacco, or the add-on, is such that the total volatile liquid content of the tobacco following treatment will be between about 60 and 80%, said percentage being determined as follows:

$$\text{add on} = \frac{\text{weight of total volatile liquid} \times 100}{\text{weight of dry tobacco solids} + \text{weight of total volatile liquid}}$$

wherein total volatile liquid = initial moisture content of the stems plus the amount of volatile substances such as $H_2O$, $H_2O_2$ and $NH_4OH$ in the applied peroxide mixture. In other words, the amount of the hydrogen peroxide mixture employed is such as to provide an amount of total volatile liquid which is between about 1.5 and 4 times the dry weight of the treated tobacco. When tobacco stems are employed having a higher initial moisture content, i.e. 30 to 40%, correspondingly less liquid should be applied by way of the hydrogen peroxide mixture. Upon being sprayed with the above-stated quantity of hydrogen peroxide mixture, the stems become soft and swollen due to the effect of the imbibed mixture, and will not exhibit runoff of excess liquid. It is generally preferable to maintain the peroxide-treated stems at a temperature between about 75° and 100° C. for a period of time between 10 and 50 minutes to allow interaction of the peroxide and the stems.

While we do not wish to be bound to any particular theory, it is believed that the hydrogen peroxide decomposes on contact with the tobacco in several different modes which are base catalyzed. In one mode, oxygen is liberated which serves as a blowing agent to expand cells within the tobacco structures. In a second mode, carbohydrate material (particularly in the water soluble fraction of the tobacco) is oxidized to produce carboxyl groups and carbon dioxide. In a third mode, the tobacco is bleached to a lighter color.

The critical amount of liquid added to the stems by way of the hydrogen peroxide mixture is sufficient to fill or close open cells of the swollen tobacco. The liquid thereby serves as a temporary plug for the open cell, causing sufficient pressure build-up from the evolving oxygen to expand the softened walls of the cell. An audible popping noise is in fact generally evident during the reaction. Excessive liquid, namely an add-on greater than 80%, causes solubles in run-off liquid to interadhere adjacent tobacco shreds, causing undesirable clumping, and therefore is to be avoided.

As carboxyl groups and carbon dioxide form within the tobacco, they interact with the calcium compounds dissolved or dispersed in the peroxide mixture to form insoluble calcium carboxylates and calcium carbonate which deposit within the tobacco in a structurally supporting manner. As the dissolved calcium compounds are utilized, calcium compounds in dispersed state in the peroxide mixture enter the dissolved state. In this manner, calcium compounds initially dispersed in undissolved particulate form in the hydrogen peroxide mixture enter the tobacco to cause stiffening thereof.

The concentration of hydrogen peroxide in the treatment mixture will normally be in the range from about 3 to 15%, and preferably about 5 to 9%. The amount of total base in the mixture will generally be in the range of 2 to 10%, and preferably about 4 to 7%. Basic compounds which may be used include ammonium hydroxide, calcium hydroxide, calcium oxide, calcium peroxide, potassium hydroxide, basic salts of potassium and sodium and mixtures thereof.

Following treatment with the alkaline hydrogen peroxide mixture, the tobacco stems are subjected to a drying treatment at temperatures in the range of about 50° to 100° C. to reduce the moisture content to 25 to 45% OV. This step also enables the peroxide to completely react with the tobacco stems as described hereinabove.

While any conventional type of tobacco drying apparatus may be used to dry the tobacco, suitable results are obtained by static or fluidized bed drying at temperatures between about 75° and 200° C. in an air convection oven or heating tunnel associated with conveyor belts. Other suitable drying techniques include exposure to infra-red or microwave sources or a high velocity heated gas utilized in a tower or column which transports the tobacco during the drying process.

Following the drying step, the expanded tobacco is subjected to a roasting step to obtain a brown product suitable for incorporation in all types of smoking products. Generally, the tobacco is roasted at a temperature in excess of 185° C., but normally no higher than 260° C., for a duration of time sufficient to produce an irreversible weight loss in the tobacco of between about 5 and 20%, and preferably between about 4 and 10%. Depending on the temperature employed, 5 to 30 minutes is sufficient to achieve the desired weight loss and brown color.

In the roasting step, the peroxide-treated stems rapidly lose their bleached color and assume a color similar to the starting material. It is felt that this sensitivity to heat is due to chemically labile groups generated by the peroxide. During roasting, chemical cross linking probably occurs between chemically labile groups. It is also possible that calcium carboxylate compounds cross link to give ketonic bonds.

Stems treated in accordance with the process of the present invention will have an increased level of calcium content by virtue of the calcium ions imparted by the peroxide mixture. Said calcium content will range from 3 to 6%, as compared with calcium contents below 2% in the starting stem material. At least 50% of the calcium content of the tobacco product is in a water insoluble form, as determined by extraction of the tobacco with water at 100° C. using a soxhlet extractor for 25 extraction cycles.

In an optional treatment step, the peroxide-treated stems are partially dried to about 35% OV and are then conveyed into a tower confining a high velocity gas at temperatures in the range of about 300° to about 370° C. with temperatures at 325° to 350° C. being preferred. The action of the hot gas is to cause rapid evaporation of the moisture within the stems, thereby causing cellular expansion thereof. Typical suitable tower drying techniques are described below. The roasting step may be made to occur simultaneously with the tower treatment or subsequent thereto.

The tobacco may be rapidly transported to a zone where it is exposed to expansion conditions by subjecting it to heat or the equivalent. This may comprise the use of hot surfaces, or a stream of hot air, a mixture of gases and steam. It has been found that the use of a gas composition comprising at least 50% (by weight) of steam, provides particularly satisfactory results. A convenient means of expanding tobacco is to place it or to entrain it in a stream of heated gas, such as superheated steam or to place it in a turbulent air stream maintained, for example, at a temperature as high as 370° C. for a period of about 1 second to 10 minutes. The impregnated tobacco may also be heated by being placed on a moving belt and exposed to infrared heating, by exposure in a cyclone dryer, by contact in a tower with superheated steam or a mixture of steam and air or the like. Any such contacting steps should not raise the temperature of the atmosphere with which the tobacco is in contact to about about 370° C.

As is well known in the processing of any organic matter, overheating can cause damage, first to color, such as undue darkening, and finally, to the extent of charring. The necessary and sufficient temperature and exposure time for expansion without such damage is a function of these two variables as well as the state of subdivision of the tobacco. Thus, to avoid undesirable damage in the heating step, the tobacco should not be exposed to the higher temperature levels, e.g., 370° C., longer than 1 to 2 seconds.

The expanded tobacco prepared according to the process described hereinabove may be blended with conventional tobacco filler at levels ranging from about 1 to about 50% by weight of the total filler. Thereafter the filler is incorporated into smoking articles such as cigarettes, cigars, cigarillos and the like, or may be used in pipe tobaccos. Smoking products containing the expanded stems prepared in accordance with the instant inventive process have been found to deliver less TPM on smoking.

As used throughout this specification, the term "cylinder volume" refers to a measurable characteristic of the tobacco which is generally indicative of its filling power, namely its propensity to fill a cigarette wrap paper. The term "oven volatiles content" or "oven volatiles" refers to the amount of relatively volatile substances (primarily water) measured under standardized conditions. As used throughout this application, the values employed in connection with these terms are determined as follows.

Cylinder Volume (CV)—Tobacco filler weighing 10.000 grams is placed in a steel cylinder having a polished inside surface and I.D. of 3.358 cm. The tobacco is compressed for 5 minutes by a 1875 gram piston of 3.335 cm diameter acting under gravity alone. The resulting volume of the compressed filler is measured and recorded as $CV_{10}$ in units of cc/gram. The test is repeated using a fresh 5.000 gram sample of the same tobacco, and the result is recorded as $CV_5$ in units of cc/gram. Said measurements are carried out at standard environmental conditions of 23.9° C. and 60% relative humidity (RH), the samples having been preconditioned under standardized conditions in this environment for 18 hours because the CV values vary with moisture content of the tobacco.

Said two points of data are then utilized to extrapolate to a zero weight sample by the following equation:

$$CV_o = 2CV_5 - CV_{10}$$

where $CV_o$ is the intrinsic cylinder volume in units of cc/gram. The derived intrinsic cylinder volume characterization minimizes the effects of experimental artifacts such as the frictional interaction of the tobacco with the wall of the cylinder.

Oven-Volatiles Content (OV)—The sample of tobacco filler is weighed before and after exposure for 3 hours in a circulating air oven controlled at 100° C. The weight loss as percentage of initial weight is oven-volatiles content.

Specific Volume (SV)—An accurately weighed sample of dry tobacco is placed in the sample chamber of a Mercury Intrusion Porosimeter made by the American Instrument Company of Silver Spring, Md. The chamber is evacuated to a pressure below 50 millitor, and mercury is then admitted to engulf the tobacco sample. By determining the weight of the mercury-filled chamber with and without the tobacco sample, the weight of mercury displaced by the tobacco is found. This provides a measure of the volume of the tobacco shreds, and is expressed as (SV) in units of cc/gram.

Stiffness Index (SI)—The $CV_o$ for any given tobacco sample is additively comprised of the specific volume (SV) of the tobacco shreds plus the interstitial volume (IV), namely the volume of space between the shreds. The interstitial volume is substantially dependent upon the stiffness of the tobacco. For example, if the tobacco exhibited perfect plastic deformation, there would be no interstitial volume, and $CV_o$ would equal SV. Therefore, $IV = CV_o - SV$, and the stiffness index (SI) may be defined as: $IV/CV_o$ which essentially indicates the fraction of $CV_o$ which may be attributed to stiffness characteristics of the tobacco sample.

Resistance to Draw (RTD) is defined as the pressure developed by the full length of a cigarette when air is pulled through it at the rate of 17.5 ml/second (20° C., 760 torr.); this value is expressed as inches of water.

Total Particulate Matter (TPM) is that portion of smoke which is collected on a Cambridge filter pad during automatic or mechanical smoking.

EXAMPLE 1

Bright tobacco stem material in the form of shreds, which had been prepared by a rolling operation while moist followed by cutting at 120 cuts/inch, was dried to an OV of 5%. 170.25 grams of the stem material was dry blended with 9.0 grams of $Ca(OH)_2$ powder in a rotating drum.

A hydrogen peroxide solution containing 116.7 grams of 30% $H_2O_2$, 17.1 grams of 29.3% $NH_4OH$, and 366.2 grams of a saturated aqueous solution of $Ca(OH)_2$ was prepared. 442.6 grams of the solution were sprayed onto the stem material at room temperature while rotating within the drum. Within 10 minutes following contact with the solution, the stem material exhibited exothermic heat of reaction, bleaching, visibly apparent enlargement of the average shred size, and a noise which may be characterized as a hissing, popping, or effervescent sound.

The sprayed material was placed in a plastic bag where it was stored at 75° C. for 30 minutes to allow the chemical reaction to go to completion. The material was then dried in a tray at 75° C. in an air-circulating oven to an OV of 10%. The dried material, when tested with starch-iodide paper, was found to be free of unreacted hydrogen peroxide.

The dried treated material was then roasted at 210° C. in separate experiments for different periods of time to ascertain the affect of roasting on weight loss, color, and cylinder volume. For comparison purposes, samples of the starting shredded stem material were also subjected to roasting. The data obtained are presented in Table 1.

TABLE 1

| | Experimental | | Control | |
|---|---|---|---|---|
| Duration of Roasting (minutes) | Weight Loss (%) | Cylinder Volume* ($CV_{10}$) (cc/10 grams) | Weight Loss (%) | Cylinder Volume* ($CV_{10}$) (cc/10 grams) |
| 0 | 0 | 55.8 | 0 | 43.0 |
| 8 | 6.4 | 75.7 | 9.7 | 57.1 |
| 13 | 11.1 | 86.8 | 16.1 | 69.1 |
| 18 | 13.7 | 77.0 | 18.3 | 69.5 |
| 23 | 15.7 | 77.7 | 21.1 | 73.5 |
| 28 | 20.0 | 77.7 | 23.0 | 72.6 |

*determined following re-equilibration with moisture at 70° C. and 46% RH

It was observed that the experimental samples which incurred a weight loss between about 6 and 14% had a satisfactory brown color. Those samples which underwent a weight loss greater than about 14% were of a dark, almost black color and were extremely brittle. The data and related observations therefore suggest that roasting causes a desirable increase in cylinder volume and color in the experimental samples, but the extent of roasting should be limited to conditions causing less than about a 14% weight loss.

EXAMPLE 2

Using the same starting material employed in Example 1, 5.5 pounds of stem shreds having an OV of 10% were sprayed while in a rotating drum with 14.64 pounds of an aqueous dispersion prepared as follows:

137.2 parts by weight of 30% $H_2O_2$ were mixed with 54.6 parts of 29.3% $NH_4OH$ to form a homogeneous solution. 14.0 parts of $Ca(OH)_2$ powder were dispersed in 398.4 parts of $H_2O$, and this dispersion was mixed with the aforesaid homogeneous solution.

The complete aqueous dispersion was utilized shortly after its preparation in order to minimize settling of the $Ca(OH)_2$ and decomposition of the mixture. The ratios of tobacco and aqueous dispersion sprayed thereon are such that a 75% add-on was applied to the tobacco.

A portion of the sprayed tobacco was dried at 75° C. in an air-circulating oven, and then roasted at 185° C. for 15 minutes to obtain a tobacco-like brown color. Further characteristics of this product, designated Sample A, are presented in Table 2.

Another portion of the sprayed tobacco, following drying, was not subjected to the roasting step. This material, having a yellow color and designated Sample B, was subjected to the same characterization tests applied to Sample A.

A still further portion of the sprayed tobacco was dried at 75° C. to an OV of 35%. The material was then conveyed into a vertical drying tower confining steam blowing upwardly at a velocity of 100 ft/sec and at a temperature of 366° C. The tobacco exiting the tower, having an OV of about 8%, was roasted under conditions identical to those used for Sample A. This product, designated Sample C, was tested; the results are shown in Table 2.

For comparison purposes, the starting material was tested; the results are presented as Sample D in Table 2.

As the data of Table 2 indicate, the roasting step caused an increase in filling power ($CV_o$) primarily by virtue of effecting a stiffening of the tobacco shreds. The tower drying step caused an increase in filling power ($CV_o$) primarily by virtue of effecting an expansion as reflected by the increase in specific volume. Similarly, the spray treatment alone, without subsequent roasting, is seen to cause an expansion and attendant increase in SV.

TABLE 2

| Sample Designation | Characterization Tests | | |
|---|---|---|---|
| | S.V. | $CV_o$ | S.I. |
| A | 2.94 | 5.62 | .48 |
| B | 2.74 | 4.53 | .40 |
| C | 3.83 | 5.70 | .33 |
| D | 1.26 | 3.10 | .60 |

EXAMPLE 3

Stems as prepared in Example 1 were divided into five lots, each weighing 113.5 grams and having an OV of 4%. Each lot was dry blended with 6 grams of $Ca(OH)_2$ powder. Each lot was then separately sprayed with 295.1 grams of a hydrogen peroxide solution containing varied amounts of $NH_4OH$. The resultant add-on for each lot was 73%. The compositions of the five solutions were as follows:

TABLE 3a

| Ingredients | Quantities (grams) | | | | |
|---|---|---|---|---|---|
| | A | B | C | D | E |
| 30% $H_2O_2$ | 93.3 | 93.3 | 93.3 | 93.3 | 93.3 |
| 29.3% $NH_4OH$ | 0.0 | 3.4 | 10.2 | 13.6 | 20.5 |
| $H_2O$ | 306.7 | 303.3 | 296.5 | 293.1 | 286.2 |

Each lot, following spraying, was placed in a sealed polyethylene bag and maintained at 75° C. for 30 minutes to permit completion of the reaction while avoiding evaporation of water and/or ammonia. The tobacco was then dried in an open tray in a forced air oven at 75° C. Each lot was then tested for pH and qualitative presence of peroxide, the results of said tests being as follows:

TABLE 3b

| Sample Designation | pH | Peroxide Presence |
|---|---|---|
| A | 5.69 | + |
| B | 5.90 | + |
| C | 6.55 | − |
| D | 6.58 | − |
| E | 6.62 | − |

The data of Table 3b indicate that ammonium hydroxide causes greater reactivity of the hydrogen peroxide. It is also noteworthy that, despite the relatively large quantities of alkaline substances used, e.g. $Ca(OH)_2$ and $NH_4OH$, the treated tobacco has an acidic pH, thereby indicating the formation of acidic species, e.g. carboxylic groups and $CO_2$, which neutralize the alkaline substances.

The dried samples were then roasted at 182° C. for 10 minutes to produce brown colored products. The samples, following equilibration with moisture under standardized conditions, provided the test data shown in Table 3C. For comparison purposes, the untreated starting material is presented as Sample F. For further comparison, a sample, a designated G, was prepared by having been spray treated with distilled water to a 73% add-on, and then dried and roasted as in Samples A through E.

TABLE 3c

| Sample Designation | $CV_{10}$ (cc/10 grams) | OV (%) |
|---|---|---|
| A | 58.0 | 13.1 |
| B | 59.3 | 12.9 |
| C | 57.1 | 12.8 |
| D | 62.4 | 12.8 |
| E | 64.2 | 12.6 |
| F | 31.4 | 14.3 |
| G | 49.1 | 12.5 |

As the data of Table 3c indicate, improved values of $CV_{10}$ are produced even when no $NH_4OH$ is utilized. However, use of the $NH_4OH$ appears to provide some improvement in $CV_{10}$ in addition to the aforementioned advantage of causing elimination of excess peroxide from the treated stems.

EXAMPLE 4

A 50/50 mixture of bright and burley stems weighing two pounds having an OV of 10% was dry blended with 112 grams of $Ca(OH)_2$ powder and subsequently uniformly sprayed at room temperature with 10.8 pounds of a solution comprising 137.6 parts of 30% $H_2O_2$, 54.6 parts of 29.3% $NH_4OH$, and 420.7 parts water. The amount of solution sprayed onto the tobacco represents a 75% add-on.

Within about 10 minutes after having been spray-treated, the originally brown tobacco shreds became yellow in color and expanded in size while exhibiting an effervescent sound. No exothermic heat of reaction was apparent, the temperature during spray treatment remaining at about 23° C.

Following spraying, the tobacco material was placed in a shallow open tray and dried in an air-circulating oven at 75° C.

The dried stems were then roasted at 225° C. for 30 minutes to obtain a brown colored product.

The stem material thus treated had a $CV_{10}$ of 83.3 cc/10 grams at an OV of 11.7%. By way of comparison, the untreated starting stem material had a $CV_{10}$ of only 41.2 cc/10 grams at an OV of 12.9%.

EXAMPLE 5

One hundred pounds of bright rolled and cut tobacco stems having an OV of 12% were dried at 100° C. to reduce the moisture content to 4%. Thereafter the stems were passed through a rotating drum and uniformly sprayed with 296 pounds of a liquid dispersion containing the following ingredients:

83.3% $H_2O$
6.8% $H_2O_2$ (30%)
2.6% $NH_4OH$
2.3% $Ca(OH)_2$

The sprayed material was heated at 75° C. in an air convection oven to reduce the OV to 35% and then the partially dried stems were fed into a steam expansion tower at 690° F. to effect further expansion. The expanded stems were then roasted at 220° C. for 3 minutes to produce darkening, stiffening and an attendant irreversible weight loss of 8%. The expanded tobacco stem product had an equilibrated OV of 12% and a cylinder volume ($CV_{10}$) of 85 cc/10 grams as compared to the starting material which had a cylinder volume of 31 cc/10 grams and an OV of 14%. By way of further comparison, a sample of the starting stems was moistened to an OV of 35% and fed into the same expansion tower. The resultant product, following reequilibration with moisture had a $CV_{10}$ of 45 and an OV of 12.8.

EXAMPLE 6

The starting stem material of Example 1 having an OV of 10% was utilized in an experiment conducted to determine the effect of incorporating the multivalent compound in the hydrogen peroxide mixture versus incorporating the multivalent compound in the stems to be treated.

A 113.5 gram quantity of said stems was dry blended with 7.0 grams of CaO and then sprayed while in a rotating drum with a solution containing 7% $H_2O_2$ and 2.7% $NH_4OH$. Sufficient solution was utilized to achieve an add-on of 75%. The sprayed stems were then dried at 75° C. and roasted at 220° C.

A second 113.5 gram quantity of said stems was sprayed while in a rotating drum with a dispersion of CaO in a solution comprised of 7% $H_2O_2$ and 2.7% $NH_4OH$. Sufficient solution was utilized to achieve an add-on of 75% containing 7 grams of CaO. The sprayed stems were then dried at 75° C. and roasted at 220° C.

Testing of the two different samples provided the following results:

TABLE 4

| | $CV_{10}$ | % OV |
|---|---|---|
| CaO on the stems | 60.0 | 13.0 |
| CaO in the peroxide mixture | 68.5 | 13.0 |
| Untreated starting stems | 31.0 | 14.0 |

As the above data suggest, both process embodiments provide improved products. However, incorporation of the multivalent compound into a hydrogen peroxide mixture appears to be preferred.

EXAMPLE 7

In order to determine the effects of the OV of the starting stem material, the stem material of Example 1 was conditioned in separate batches to moisture contents of 3%, 11% and 24%. Each batch, having a dry basis weight of 100 grams, was dry blended with 6.0 grams of $Ca(OH)_2$ powder.

Each batch was spray treated while in a rotating drum with a solution comprising 68.8 grams of 30% $H_2O_2$, 27.3 grams of 29.3% $NH_4OH$ and sufficient water such that the solution, when added to the stem material would provide a 75% add-on. The three batches of spray treated stem materials were identically dried at 75° C., and roasted at 175° C. to a brown color.

The resultant products exhibited the following properties.

TABLE 5

| Initial Moisture | $CV_{10}$ | % OV |
|---|---|---|
| 3% | 67.7 | 12.8 |
| 11% | 63.0 | 12.0 |
| 24% | 51.0 | 13.4 |

The data therefore suggest that improved results are obtained in the process of this invention when the initial moisture content (OV) of the stem material is below about 12%.

EXAMPLE 8

The product designated Sample C in Example 2 hereinabove was blended in various quantities with a mixture of burley, bright and oriental tobaccos as used in producing a conventional blended cigarette, and the mixtures were utilized in producing cigarettes of equal firmness. The cigarettes produced were of 25 mm circumference, 63 mm length and provided with a 21 mm filter of cellulose acetate tow. The cigarettes produced may be further characterized as follows:

TABLE 6

| % Sample C in the Blend | Cigarette Weight (grams) | Subjective Smoking Characteristics |
|---|---|---|
| 0 | 1.140 | acceptable |
| 5 | 1.035 | mild |
| 15 | .945 | milder |
| 25 | .905 | very mild |

As the data of the above table indicate, use of the product of the present invention in admixture with other tobacco components permits formation of a cigarette comprising less total weight of tobacco. Such weight reduction provides less total smoke delivery with attendant milder subjective response, and permits reduction in the cost of the cigarette.

By way of comparison, cigarettes of the same dimensions and firmness were made using the same type blend of tobacco, but replacing Sample C of Example 2 at the several blend levels with Samples D and E of Example 2. It was found that such cigarettes were of heavier weight and were considered to provide much harsher smoking characteristics.

EXAMPLE 9

The stem material of Example 1 at 2% OV was treated in separate batches of 204.3 grams weight (dry weight basis) with the aqueous hydrogen peroxide dispersions described below wherein the weights of the several components are in grams and the corresponding add-on is shown in percent.

Each batch, following spray treatment in a rotating drum, was dried in an open tray at 75° C. in an air-circulating oven, and was subsequently roasted at 195° C. for about 8 minutes. Product characterization data for each batch is shown adjacent the peroxide composition used in the treatment thereof.

TABLE 7

| $H_2O$ | CaO | $H_2O_2$ (30%) | $NH_4OH$ (29.3%) | Add-On (%) | $CV_o$ | OV (%) |
|---|---|---|---|---|---|---|
| 35.2 | 10.6 | 137.2 | 54.6 | 55 | 3.9 | 12.9 |
| 104.0 | 10.6 | 137.2 | 54.6 | 60 | 5.0 | 13.0 |
| 177.0 | 10.6 | 137.2 | 54.6 | 65 | 5.4 | 12.5 |
| 274.3 | 10.6 | 137.2 | 54.6 | 70 | 5.15 | 12.8 |
| 336.2 | 10.6 | 137.2 | 54.6 | 72.5 | 5.2 | 13.5 |
| 410.5 | 10.6 | 137.2 | 54.6 | 75 | 5.6 | 13.3 |
| 602.7 | 10.6 | 137.2 | 54.6 | 80 | 5.1 | 13.1 |
| 943.2 | 10.6 | 137.2 | 54.6 | 85 | * | |

*No useful product was obtained because the sprayed-on solution caused run-off of liquid which in turn caused interadherence of the tobacco shreds.

As the data of the above table indicate, significant improvement in the filling power ($CV_o$) of the tobacco is not achieved until an add-on level of at least 60% is utilized. At add-on levels above about 80%, unsatisfactory results are again obtained.

EXAMPLE 10

The stem material of Example 1 at 2% OV was treated in separate batches of 204.3 grams weight (dry weight basis) with the aqueous hydrogen peroxide dispersions described below wherein the weights of the several components are in grams, and the corresponding add-on is shown in percent. The dispersions were made in the manner described in Example 2.

Each batch, following spray treatment in a rotating drum, was dried in an open tray at 75° C. in an air-circulating oven, and was subsequently roasted at 195° C. for about 8 minutes. Product characterization data for each batch is shown adjacent the peroxide composition used in the treatment thereof.

TABLE 8

| $H_2O$ (grams) | CaO (grams) | $H_2O_2$ (30%) | $NH_4OH$ (29.3%) | Add-On (%) | $CV_o$ (cc/gram) | OV (%) | S.I. | Ca* (%) |
|---|---|---|---|---|---|---|---|---|
| 410.5 | 20.0 | 137.2 | 54.6 | 75 | 4.60 | 12.2 | .35 | 8.38 |
| 410.5 | 15.9 | 137.2 | 54.6 | 75 | 5.85 | 12.3 | .43 | 6.95 |
| 410.5 | 13.25 | 137.2 | 54.6 | 75 | 5.95 | 13.1 | .51 | 6.02 |
| 410.5 | 10.6 | 137.2 | 54.6 | 75 | 6.0 | 13.0 | .52 | 5.10 |
| 410.5 | 7.95 | 137.2 | 54.6 | 75 | 6.05 | 13.1 | .53 | 4.17 |
| 410.5 | 5.30 | 137.2 | 54.6 | 75 | 5.3 | 13.7 | .46 | 3.25 |
| 410.5 | 0.00 | 137.2 | 54.6 | 75 | 4.5 | 14.8 | .30 | 1.40 |

*determined by atomic absorption conducted on the ash of each sample

As the data of this example indicate, incorporation of calcium oxide into the hydrogen peroxide mixture to the extent of producing a product containing at least 3% calcium produces products having increased filling power as indicated by $CV_o$ values. Excess amounts of calcium oxide, namely amounts wherein the resultant product contains more than about 7% calcium, achieve little benefit in terms of improvement of $CV_o$. It therefore appears that, by virtue of the process of the present invention, best results are secured when conditions are adjusted so as to produce a tobacco product having a calcium content in the range of 3 to 7%.

It is of further interest to note that the role of the added calcium appears to be that of stiffening the tobacco, because the values of the stiffness index S.I. closely parallel the $CV_o$ values.

EXAMPLE 11

The stem material of Example 1 at 2% OV was treated in separate batches of 204.3 grams weight (dry weight basis) with the aqueous hydrogen peroxide dispersion described below wherein the weights of the several components are in grams, and the corresponding add-on is shown in percent. The dispersions were made in the manner described in Example 2.

Each batch, following spray treatment in a rotating drum, was dried in an open tray at 75° C. in an air-circulating oven, and was subsequently roasted at 195° C. for about eight minutes. Product characterization data for each batch is shown adjacent the peroxide composition used in the treatment thereof.

TABLE 9

| $H_2O$ grams | CaO grams | $H_2O_2$ (30%) grams | $NH_4OH$ (29.3%) grams | Add-On (%) | $H_2O_2$ (%) | $CV_O$ cc/grams | OV (%) |
|---|---|---|---|---|---|---|---|
| 410.5 | 7.95 | 137.2 | 54.6 | 75 | 6.74 | 6.05 | 13.1 |
| 444.8 | 7.95 | 102.9 | 54.6 | 75 | 5.06 | 3.59 | 13.4 |
| 479.1 | 7.95 | 68.6 | 54.6 | 75 | 3.37 | 3.93 | 13.1 |

Based upon the $CV_0$ values obtained for the samples treated in the manner of this example, it appears that the concentration of $H_2O_2$ in the dispersion should preferably be above about 5%.

EXAMPLE 12

The stem material of Example 1 at 2% OV was treated in separate batches of 204.3 grams weight (dry weight basis) with the aqueous hydrogen peroxide dispersions described below wherein the weights of the several components are in grams and the corresponding add-on is shown in percent. The dispersions were made in the manner described in Example 2.

Each batch, following spray treatment in a rotating drum, was dried in an open tray at 75° C. in an air-circulating oven, and was subsequently roasted at 195° C. for about eight minutes. Product characterization data for each batch is shown adjacent the peroxide composition used in the treatment thereof.

TABLE 10

| Experiment | $H_2O$ grams | CaO grams | $H_2O_2$ (30%) grams | $NH_4OH$ (29.3%) grams | Add-On (%) | $NH_4OH$ (%) | $CV_O$ | SI | (%) |
|---|---|---|---|---|---|---|---|---|---|
| A | 383.2 | 7.9 | 137.2 | 81.9 | 75 | 3.93 | 4.79 | .40 | 14.1 |
| B | 396.8 | 7.9 | 137.2 | 68.2 | 75 | 3.27 | 5.95 | .55 | 14.0 |
| C | 410.5 | 7.9 | 137.2 | 54.6 | 75 | 2.62 | 6.05 | .53 | 13.1 |
| D | 424.2 | 7.9 | 137.2 | 40.9 | 75 | 1.96 | 5.80 | .51 | 14.0 |
| E | 437.8 | 7.9 | 137.2 | 27.3 | 75 | 1.31 | 5.80 | .52 | 14.1 |
| F | 465.1 | 7.9 | 137.2 | 0 | 75 | 0 | 4.65 | .47 | 13.3 |

The dispersion utilized in Experiment F, containing no $NH_4OH$, had a pH of 9.05. The solution utilized in Experiment C had a pH of 10.26.

As the data indicate, the presence of ammonium hydroxide causes increased $CV_0$ and SI. However, when the concentration of ammonia in the dispersion exceeds about 3.5%, the advantages of using ammonia appear to be lost. Within the experimental conditions of this example, the preferred concentration of $NH_4OH$ in the dispersion appears to be between about 1 and 3.5%.

EXAMPLE 13

Experiment C of Example 12 was repeated with the exception that various amounts of diammonium phosphate were uniformly incorporated into the starting stem material. The experiments run and data obtained are as follows:

TABLE II

| Experiment | DAP (%)* | $CV_{10}$ (cc/10 grams) | $CV_O$ (cc/gram) | OV |
|---|---|---|---|---|
| A | 2 | 72.6 | 6.74 | 11.9 |
| B | 3 | 74.4 | 6.92 | 11.8 |
| C | 4 | 64.7 | 5.62 | 12.4 |
| D | 5 | 61.1 | 5.77 | 12.5 |

*Diammonium phosphate-based upon dry weight of the stem material

By comparison with Experiment C of Example 12, which provided a $CV_0$ of 6.05, the use of amounts of DAP at the level of 1 to 3% appears to provide improved results as indicated by the increase in $CV_0$.

What is claimed is:

1. A process for expanding rolled and cut tobacco stems which comprises the steps of:

(a) treating tobacco stems having a moisture content between about 2 and 40% with an aqueous hydrogen peroxide mixture under alkaline conditions and in the presence of at least one compound of a multivalent metal to expand and bleach said stems, and (b) drying the peroxide-treated tobacco stems to effect removal of water, and roasting the dried stems to restore a tobacco-like color thereto.

2. The process of claim 1 wherein said stems are made to contain an alkaline compound prior to treatment with said hydrogen peroxide mixture.

3. The process of claim 1 wherein said stems are made to contain a compound of a multivalent metal prior to treatment with said hydrogen peroxide mixture.

4. The process of claim 3 wherein the tobacco stems are dry blended with a hydroxide, oxide or peroxide of a multivalent metal prior to treatment with the hydrogen peroxide mixture.

5. The process of claims 3 and 4 wherein the multivalent metal is calcium.

6. The process of claim 1 wherein the moisture content of the stems is 4 to 12% prior to treating with the hydrogen peroxide mixture.

7. The process of claim 1 wherein said hydrogen peroxide mixture contains dispersed therein a sparingly soluble alkaline calcium compound.

8. The process of claim 5 wherein the multivalent metal comprises between 0.5 and 3.0% by weight of the hydrogen peroxide composition.

9. The process of claim 1 wherein the initial pH of the peroxide mixture in contact with the stems is between about 9 and 12.

10. The process of claim 1 wherein the hydrogen peroxide mixture contains between 2 and 10% of a basic compound, said compound being selected from the group consisting of a hydroxide of ammonia, potassium, sodium and mixtures thereof.

11. The process of claim 1 wherein the hydrogen peroxide mixture contains between 3 and 15% of hydrogen peroxide based on the total weight of the mixture.

12. The process of claim 1 wherein the peroxide-treated stems are maintained at a temperature between about 75° and 100° C. for a period of time between about 10 and 50 minutes to allow interaction of the peroxide and the stems.

13. The process of claim 1 wherein following treatment of the stems with the peroxide mixture and prior to roasting, drying is conducted to achieve a moisture content in the range of about 25 to 45%, and further drying is achieved by a rapid heating method which causes further expansion of said stems.

14. The process of claim 1 wherein the amount of volatile liquid contained by the stems having been treated with the peroxide mixture is between 60 and 80% add-on, said add-on being defined by the expression:

add on =

-continued $$\frac{\text{weight of total volatile liquid} \times 100}{\text{weight of dry tobacco solids} + \text{weight of total volatile liquid}}$$

15. The process of claim 1 wherein said roasting is done at a temperature between about 185° to 260° C. and for a period of time sufficient to produce a weight loss in the stems of between about 5 and 20%.

16. The process of claim 11 wherein the stems are roasted for a period of time between about 5 to 30 minutes.

17. Brown colored expanded tobacco stem material in shred form suitable for blending with cut tobacco for the production of cigarettes, said material having an equilibrated moisture content between about 10 and 14%, a calcium ion content between 3 and 6%, of which calcium ion content at least 50% is water insoluble, with the charge-balancing anions for said calcium ions being derived from carboxyl groups and $CO_2$ generated by the oxidation of tobacco components, said shreds having an intrinsic cylinder volume between 4 and 7 cc/gram, a specific volume between 4 and 7 cc/gram, a specific volume between 2 and 5 cc/gram, and a stiffness index between 0.3 and 0.6.

* * * * *

UNITED STATES PATENT AND TRADEMARK OFFICE

CERTIFICATE OF CORRECTION

PATENT NO. : 4,388,933

DATED : June 21, 1983

INVENTOR(S) : Norman B. Rainer et al

It is certified that error appears in the above—identified patent and that said Letters Patent is hereby corrected as shown below:

Column 2, line 64, "salts is" should read --salts in--.

Column 11, line 12, "a designated" should read --designated--.

Column 16, line 1, "Table II" should read --Table 11--.

Column 18, line 22, Claim 17: Delete "a specific volume between 4 and 7 cc/gram,".

Signed and Sealed this

*Eighteenth* Day of *October 1983*

[SEAL]

*Attest:*

GERALD J. MOSSINGHOFF

*Attesting Officer*

*Commissioner of Patents and Trademarks*